US006338248B1

(12) United States Patent
Waidner et al.

(10) Patent No.: US 6,338,248 B1
(45) Date of Patent: Jan. 15, 2002

(54) HEATING AND REFRIGERATING MACHINE, ESPECIALLY A VUILLEUMIER HEAT PUMP OR A STIRLING ENGINE

(75) Inventors: Juergen Waidner, Notzingen; Marcus Bienzle, Ostfildern, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/647,838

(22) PCT Filed: Jan. 28, 2000

(86) PCT No.: PCT/DE00/00242

§ 371 Date: Feb. 2, 2001

§ 102(e) Date: Feb. 2, 2001

(87) PCT Pub. No.: WO00/46495

PCT Pub. Date: Aug. 10, 2000

(30) Foreign Application Priority Data

Feb. 6, 1999 (DE) ..... 199 04 923

(51) Int. Cl.[7] ..... F01B 29/10
(52) U.S. Cl. ..... 60/521; 60/522; 60/524
(58) Field of Search ..... 60/516, 517, 520, 60/521, 522, 524

(56) References Cited

U.S. PATENT DOCUMENTS 3,636,719 A * 1/1972 Shintaro et al. ..... 60/521 X
3,813,881 A * 6/1974 Neelen ..... 60/521
3,817,035 A * 6/1974 Hakansson ..... 60/521
4,179,891 A * 12/1979 Gronvall ..... 60/521

FOREIGN PATENT DOCUMENTS

| | | |
|---|---|---|
| DE | 195 16 499 | 12/1996 |
| DE | 197 25 646 | 12/1998 |
| DE | 197 33 226 | 2/1999 |
| WO | WO97 15379 | 5/1997 |

* cited by examiner

*Primary Examiner*—Hoang Nguyen
(74) *Attorney, Agent, or Firm*—Kenyon & Kenyon

(57) ABSTRACT

A heating and refrigerating machine, especially a Vuilleumier heat pump or Stirling engine, in which a gas-air mixture is combusted in a combustion chamber and the exhaust gas radiates thermal energy to a heater head, which functions as a housing for the hot piston of the machine, part of the outer surface of the heater head forming a portion of the combustion chamber. By using a porous-medium burner and by virtue of its adaptation to the heater head, the transmission of heat by convection and radiation is improved and a compact machine design is attained which transmits heat in a highly efficient manner with low emissions over a broad output modulation range.

15 Claims, 2 Drawing Sheets

HEATING AND REFRIGERATING MACHINE, ESPECIALLY A VUILLEUMIER HEAT PUMP OR A STIRLING ENGINE

FIELD OF THE INVENTION

The present invention relates to a heating and refrigerating machine, especially a Vuilleumier heat pump or a Stirling engine, in which a gas-air mixture is combusted in a combustion chamber and the exhaust gas radiates thermal energy to a heater head, which functions as a housing for the hot piston of the machine, part of the outer surface of the heater head forming a portion of the combustion chamber.

BACKGROUND INFORMATION

A previously proposed heating and refrigerating machine is described in German Published Patent Application No. 195 16 499 and U.S. Pat No. 5,214,923. In this machine, the gas-air mixture is fed directly into the combustion chamber, ignited and combusted. In the process, the heat transmission is brought about by convection of the exhaust gas on the wall of the combustion chamber and, thus, directly to the heater head. Therefore, only a corresponding efficiency in the energy transmission is achievable.

SUMMARY OF THE INVENTION

An object of the present invention is to improve the heat transmission efficiency of a heating and refrigerating machine and, in the process, to achieve a compact design.

This object is achieved, in one case, in that the heater head itself has a concave receptacle functioning as the combustion chamber for a porous-medium burner, the receptacle encompassing the predominant portion of the outer side of the porous-medium burner, with the exception of the intake surface for the gas-air mixture, and in that the heat transmission is brought about by convection and radiation to the heater head, and, in another case, this object is achieved in an equivalent manner in that the heater head is configured as a cylinder and is encompassed by a porous-medium burner in the form of a hollow cylinder, the gas-air mixture being admissible at the end face of the porous-medium burner or at its outer-jacket side, and in that the heat transmission is brought about by convection and radiation to the heater head.

In each case, by using a porous-medium burner, a substantial portion of the heat transmission is brought about by radiation, and by directly coupling the porous-medium burner to the heater head functioning as a part of the combustion chamber, the machine can have a compact structure and can be optimally adapted to space requirements. Moreover, in addition to the improved efficiency of the heat transmission accompanied by low emissions, a large output modulation range is achieved.

One beneficial embodiment of the present invention provides that the porous-medium burner can be arranged at a distance from the heater head or so as to have a large surface area set against the heater head in order to achieve an optimal adjustment with regard to efficiency, removal of emissions, and modulation range.

In this configuration, the porous-medium burner can completely fill the concave receptacle in the heater head.

The combustion of the gas-air mixture in the porous-medium burner can be stabilized in that the gas-air mixture can be fed to the porous-medium burner through a porous anti-blowback body, which covers the intake surface thereof. In this way, a uniform combustion process is achieved inside the porous-medium burner.

The same purpose is also served by an embodiment that is characterized in that a distribution chamber, whose output cross-section corresponds to the input cross-section of the anti-blowback body, is arranged upstream of the anti-blowback body.

The removal of the exhaust gas is ensured, in one case, in that the combustion chamber in the area of the intake surface of the porous-medium body and in the area of the anti-blowback body is covered by a housing having an exhaust outlet, or, in another case, in that the porous-medium burner is covered by a part of a housing having an exhaust gas outlet, the housing part being formed as an anti-blowback body in the area of the intake surface of the porous-medium burner.

A further benefit of the new machine is achieved in that at least one portion of the housing part is formed as a heat exchanger for a circulating liquid, which can be used as water for industrial purposes.

DETAILED DESCRIPTION

For all exemplary embodiments, only the point of interconnection between the burner and the heater head of the machine, which is the subject of the present invention, is shown. The remaining structure of the machine can be implemented in a known way as a Vuilleumier heat pump or Stirling engine, since this is not significant for the present invention. It is, after all, of primary importance that the efficiency of the heat transmission from the burner to the heater head be improved and that this be done with a structural configuration that permits a compact design of the machine.

Figure 1:
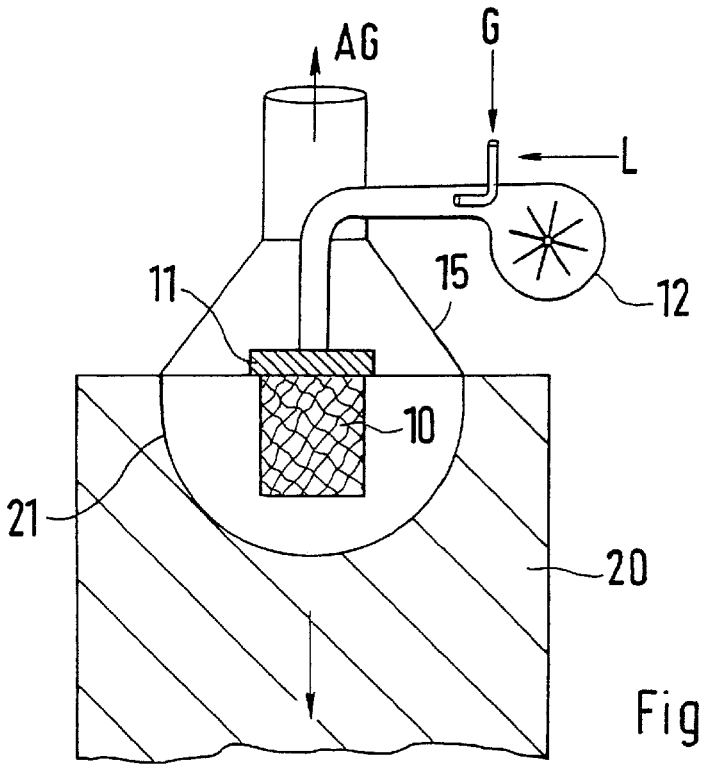
FIG. 1 shows a heater head having a concave receptacle and a porous-medium burner that is arranged at a distance from the receptacle.

In the exemplary embodiment according to FIG. 1, heater head 20 has a concave receptacle 21 in its end face in which a porous-medium burner 10 is inserted. Porous-medium burner 10 is cylindrical and can be formed as wire mesh, a porous ceramic element, and the like. It has the benefit that a more stable combustion process can thus be achieved having low emissions over a broad output modulation range.

Receptacle 21 encompasses at a distance the majority of the outer surface of porous-medium burner 10, with the exception of the intake surface for the gas-air mixture, the intake surface being covered by a plate-shaped, porous anti-blowback body 11. A distribution chamber, whose output cross-section corresponds to the input cross-section of anti-blowback body 11, can be arranged upstream from anti-blowback body 11. A fan 12 transports air L and mixes it with gas G. As a gas-air mixture, this fuel arrives in porous-medium burner 10 and combusts there after ignition (not shown).

In the area of the intake surface of porous-medium burner 10, a housing part 15, which is provided with exhaust outlet AG, completes the covering of the combustion chamber.

The heat transmission from porous-medium burner 10 to heater head 20 is brought about by convection and radiation, the proportion of the latter being especially high when a porous-medium burner 10 is used.

Figure 2:
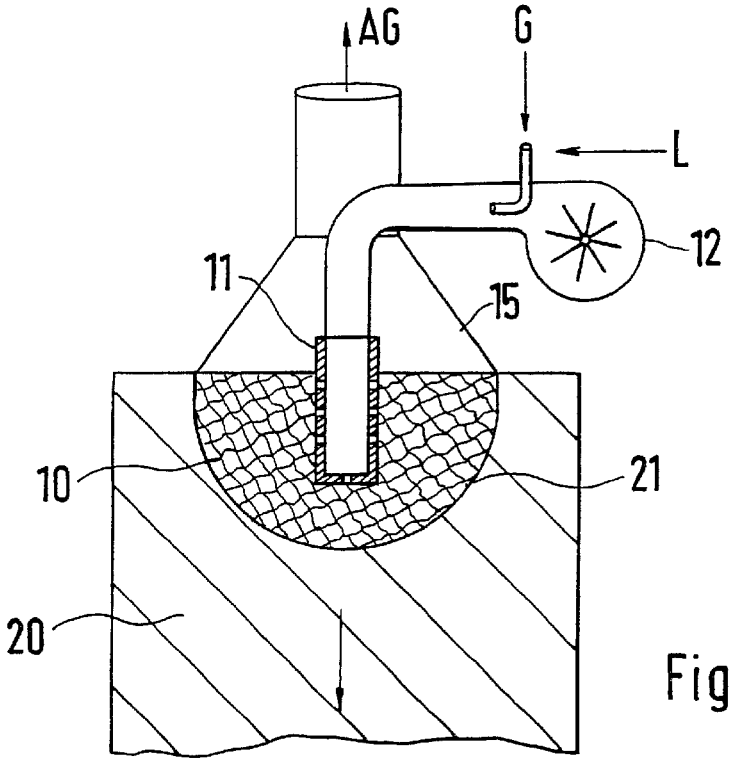
FIG. 2 shows a heater head having a concave receptacle and a porous-medium burner that completely fills the receptacle.

In the exemplary embodiment according to FIG. 2, porous-medium burner 10 completely fills concave receptacle 21 in heater head 20 and is set against it. A pot-type, porous anti-blowback body 11, through which the gas-air mixture is fed, is inserted in the center of porous-medium burner 10. In all other respects, the exemplary embodiment according to FIG. 2 is indistinguishable from the exemplary embodiment according to FIG. 1. In this context, the configuration can also vary between the two exemplary embodiments and can be adapted for porous-medium burner 10, either the variant at a distance or the one having the filled-in volume.

Figure 3:
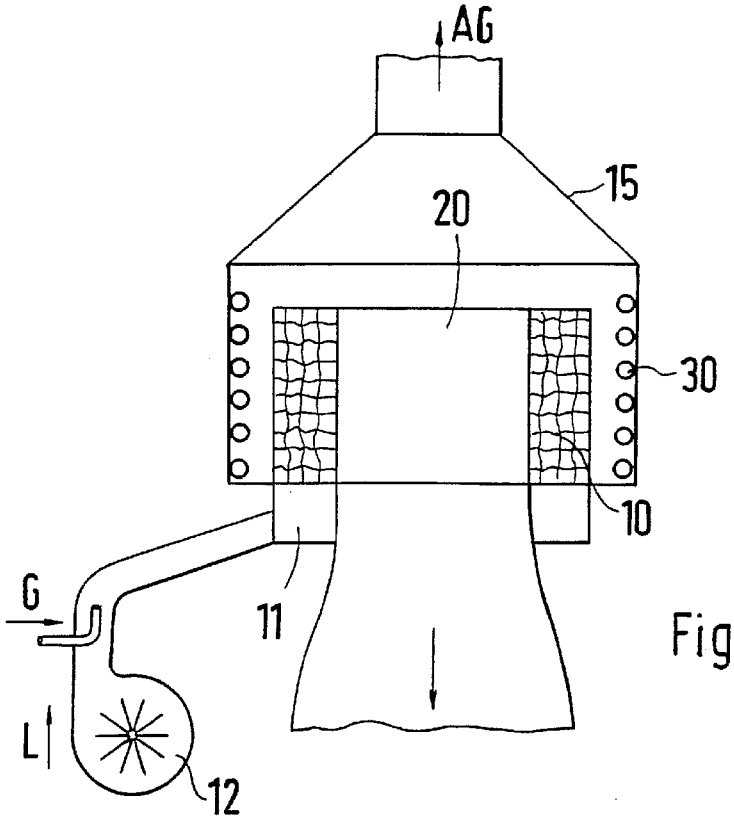
FIG. 3 shows a cylindrical heater head along with a porous-medium burner in the form of a hollow cylinder, which encompasses the heater head and to which the gas-air mixture is fed at its end face.
Figure 4:
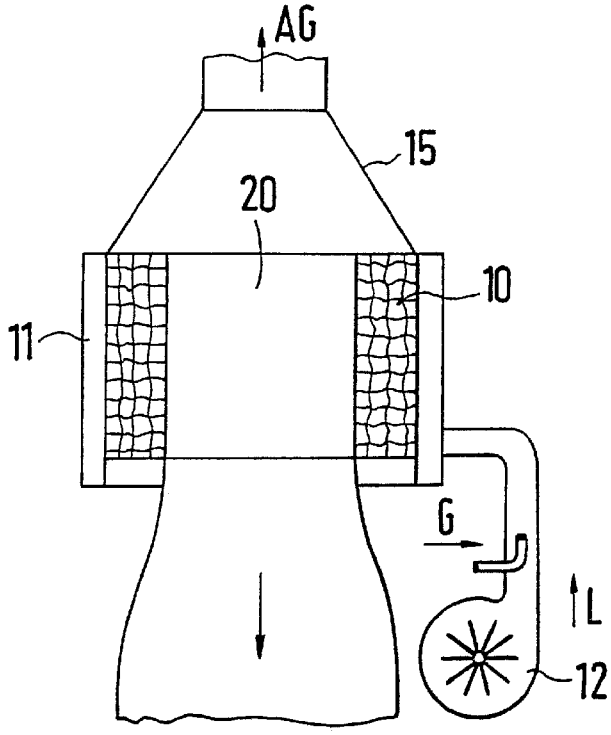
FIG. 4 shows a cylindrical heater head along with a porous-medium burner in the form of a hollow cylinder, which encompasses the heater head and to which the gas-air mixture is fed at its outer-jacket side.

In the exemplary embodiments according to FIGS. 3 and 4, heater head 20 is cylindrical and is encompassed by porous-medium burner 10 in the form of a hollow cylinder.

In the exemplary embodiment according to FIG. 3, housing part 15 is placed over the open face of heater head 20, covering the outer-jacket surface of porous-medium burner 10 down to the bottom face, which is utilized as the intake surface for the gas-air mixture and is covered by porous, annular anti-blowback body 11. Housing part 15 is provided with exhaust outlet AG. A portion of housing part 15, especially in the area of the outer-jacket surface of porous-medium burner 10, can be configured as heat exchanger 30. The circulating liquid can be used, for example, as water for industrial purposes. In this configuration, anti-blowback body 11 can also be combined with a distribution chamber arranged upstream for the gas-air mixture.

In the exemplary embodiment according to FIG. 4, the outer-jacket surface of porous-medium burner 10 is used as the intake surface for the gas-air mixture, housing part 15 in this area being configured as porous anti-blowback body 11 and being combinable with a distribution chamber.

Also in these exemplary embodiments according to FIGS. 3 and 4, porous-medium burner 10 can either be set against heater head 20 or arranged at a distance from it without detrimentally affecting the compact design of this area of the machine.

What is claimed is:

1. A heating and refrigerating machine, comprising:

a hot piston;

a porous-medium burner; and a heater head including a concave receptacle corresponding to a combustion chamber in which a gas-air mixture is combusted and corresponding to a housing for the hot piston, an exhaust gas radiating a thermal energy to the heater head, wherein:

a part of an outer surface of the heater head forms a portion of the combustion chamber, the concave receptacle functions as the combustion chamber for the porous-medium burner, the concave receptacle encompasses a predominant portion of an outer side of the porous-medium burner, except for an intake surface for the gas-air mixture, and a transmission of heat to the heater head is brought about by convection and radiation.

2. The heating and refrigerating machine according to claim 1, wherein:

the heating and refrigerating machine corresponds to one of a Vuilleumier heat pump and a Stirling engine.

3. A heating and refrigerating machine, comprising:

a combustion chamber in which an gas-air mixture is combusted;

a hot piston;

a porous-medium burner arranged as a hollow cylinder to which the gas-air mixture is capable of being fed at one of an end face thereof and an outer-jacket-side thereof; and a heater head that is cylinder-shaped and is encompassed by the hollow cylinder of the porous-medium burner, wherein:

an exhaust gas radiates a thermal energy to the heater head, the heater head corresponds to a housing for the hot piston, a part of an outer surface of the heater head forms a portion of the combustion chamber, and a transmission of heat is brought about by convection and radiation to the heater head.

4. The heating and refrigerating machine according to claim 3, wherein:

the heating and refrigerating machine corresponds to one of a Vuilleumier heat pump and a Stirling engine.

5. The heating and refrigerating machine according to claim 1, wherein the porous-medium burner is arranged according to one of:

at a distance from the heater head, and having a large surface area thereof abutting the heater head.

6. The heating and refrigerating machine according to claim 3, wherein the porous-medium burner is arranged according to one of:

at a distance from the heater head, and having a large surface area thereof abutting the heater head.

7. The heating and refrigerating machine according to claim 1, wherein:

the porous-medium burner completely fills the concave receptacle in the heater head.

8. The heating and refrigerating machine according to claim 1, further comprising:

a porous anti-blowback body covering the intake surface, wherein:

the gas-air mixture is capable of being fed to the porous-medium burner through the porous anti-blowback body.

9. The heating and refrigerating machine according to claim 3, further comprising:

a porous anti-blowback body covering an intake surface of the porous-medium burner, wherein:

the gas-air mixture is capable of being fed to the porous-medium burner through the porous anti-blowback body.

10. The heating and refrigerating machine according to claim 8, further comprising:

a distribution chamber having an output cross-section corresponding to an input cross-section of the porous anti-blowback body, the distribution chamber being arranged upstream of the porous anti-blowback body.

11. The heating and refrigerating machine according to claim 9, further comprising:

a distribution chamber having an output cross-section corresponding to an input cross-section of the porous anti-blowback body, the distribution chamber being arranged upstream of the porous anti-blowback body.

12. The heating and refrigerating machine according to claim 8, further comprising:

a housing part including an exhaust gas outlet, wherein: the combustion chamber in an area of the intake surface of the porous-medium body and the porous anti-blowback body is covered by the housing part.

13. The heating and refrigerating machine according to claim 3, further comprising:

a housing part including an exhaust gas outlet, wherein: the porous-medium burner is covered by the housing part, and the housing part is formed as an anti-blowback body in an area of an intake surface of the porous-medium burner.

14. The heating and refrigerating machine according to claim 12, wherein:

at least one portion of the housing part is configured as a heat exchanger for a circulating liquid.

15. The heating and refrigerating machine according to claim 13, wherein:

at least one portion of the housing part is configured as a heat exchanger for a circulating liquid.

* * * * *